US005106270A

United States Patent [19]

Goettel et al.

[11] Patent Number: 5,106,270

[45] Date of Patent: Apr. 21, 1992

[54] AIR-COOLED AIR COMPRESSOR

[75] Inventors: Walter E. Goettel, Monongahela; Daniel G. Wagner, Pittsburgh; Richard S. Patterson, North Versailles; Dale A. Chovan, Trafford, all of Pa.

[73] Assignee: Westinghouse Air Brake Company, Wilmerding, Pa.

[21] Appl. No.: 639,437

[22] Filed: Jan. 10, 1991

[51] Int. Cl.[5] ..... F04B 23/00; F04B 39/06

[52] U.S. Cl. ..... 417/243; 417/372

[58] Field of Search ..... 417/243, 372

[56] References Cited

U.S. PATENT DOCUMENTS

| | | | |
|---|---|---|---|
| 1,927,931 | 9/1933 | Farmer | 230/211 |
| 2,150,912 | 3/1939 | Clapp | 230/182 |
| 2,186,492 | 1/1940 | Paget | 230/211 |
| 2,580,341 | 12/1951 | Aikman | 417/243 |
| 4,830,580 | 5/1989 | Hata et al. | 417/243 |

*Primary Examiner*—Richard A. Bertsch
*Assistant Examiner*—Alfred Basichas
*Attorney, Agent, or Firm*—J. B. Sotak

[57] ABSTRACT

An air supply system having a multi-cylinder, two-stage air compressor including a pair of low pressure cylinders and a high pressure cylinder. A first intercooler interconnected between the outlet of one of the pair of low pressure cylinders and the inlet of the high pressure cylinder and a second intercooler interconnected between the outlet of the other of the pair of low pressure cylinders. An aftercooler connected to the outlet of the high pressure cylinder for effectively reducing the temperature of the compressed air supplied to a storage reservoir to near or at ambient temperature. A protective housing including a frontal screened opening for permitting a rotary fan to draw cooling air into the housing and including an internal shroud for directing the cooling air over the intercoolers and aftercooler.

20 Claims, 4 Drawing Sheets

AIR-COOLED AIR COMPRESSOR

FIELD OF THE INVENTION

This invention relates to an air-cooled, multi-cylinder, two-stage air compressor unit having an intercooler connected between low and high pressure cylinders and having an aftercooler connected to the outlet of the high pressure cylinder to effectively lower the temperature of the compressed air conveyed to a storage reservoir of locomotive air brake equipment in which a compressor-driven fan gathers and directs cooling air through a screened opening into an air collecting shroud of a protective enclosure member to effectively dissipate the heat in the intercooler and the aftercooler as well as to cool the finned cylinders and riser pipes.

BACKGROUND OF THE INVENTION

It is well known to use multi-cylinder air compressors on freight and passenger locomotives to supply compressed air to the operating and control equipment of a railway air brake system. During the operation of the air compressor, the discharge temperature of the compressed air tends to rise due to the heat of compression of the air. If there is insufficient cooling, the increased temperature of the air compressor amnd lubricating oil may cause the lubricating oil to break down resulting in an increase in viscosity. The increased viscosity of the lubricating oil can cause premature frictional wear and/or scoring of the cylinders and the compression and oil rings so that increased oil consumption occurs and results in frequent repair and maintenance. In addition, the maximum amount of moisture that pure air contains is dependent upon its temperature, pressure, and relative humidity. It will be appreciated that the higher the temperature of the air and relative humidity, the greater is the amount of moisture that it will contain and that the higher the pressure of the air, the smaller the amount of moisture that it will contain. It has been found that, when air is compressed, the rise in temperature due to the compression far more than offsets the opposite effect of the rise of pressure on the moisture-carrying capacity of the air. Therefore, water is precipitated by the cooling compressed air as it passes from the compressor to the various portions of the air brake system. Let us assume that a certain amount of atmospheric air enters a compressor at 100% relative humidity where it contains all the moisture possible at the existing outside temperature and ambient pressure. As this air is compressed and the temperature of air increases, its moisture-carrying capacity rapidly increases with the increased temperature, consequently, all the moisture is retained by this air and passes with it into the main or storage reservoir. Now if this compressed air is permitted to pass from the storage reservoir into the various parts and devices of the air supply system before being cooled to the outside ambient temperature, it will carry more moisture than it is capable of holding when the temperature finally drops to the normal point, and this excess moisture will be deposited because the pressure being high, the air cannot hold as much moisture as it did at the same temperature and at atmospheric pressure. Accordingly, in order to reduce the moisture to a minimum, it is advantageous to cool the air to the outside ambient temperature before it leaves the reservoir, thereby causing it to deposit all the excess moisture which can be quickly and easily removed by a suitable drain valve or cock. It is recommended practice on many railroads that the temperature of the compressed air in the main reservoir must be at the atmospheric ambient temperature and the condensate must be drained before being conveyed to the various downstream brake parts or components in order to prevent rust, scale, and corrosion in the control valves, cocks, gages, strainers, collectors, operating cylinders, etc. Accordingly, it has been recommended that the size and length of cooling or radiation pipe needed to keep moisture out of the main reservoir system should be that required to bring the temperature of the compressed air to within five degrees Fahrenheit (5° F.) of ambient temperature upon its entrance to the number two (No. 2) reservoir when the air compressor is operating on a load-unload cycle to deliver eighty (80) cubic feet of free air per minute. It has been found that the temperature in the No. 2 main reservoir should be at or very near ambient temperature. Thus, it is very important to have the main reservoir air cooled to as close to the ambient temperature so that when the air is expanded to a lower pressure for operating the downstream brake equipment and auxiliary devices, it will be dry and remain dry if any further cooling is encountered. From an operational standpoint, it is very important that no free water be allowed to reach the braking devices since water causes corrosion, results in the formation of sludge and washes away lubrication and in winter or cold weather freezes to cause malfunctions of the brake equipment. It will be appreciated that it is usually not very practical and extremely expensive to continually add more or a sufficient amount of two inchs (2") iron pipe to the main reservoir system to reduce the compressed air to within 5° F. of the surrounding ambient temperature before the air is permitted to enter the No. 2 main reservoir.

OBJECTS AND SUMMARY OF THE INVENTION

Accordingly, it is an object of this invention to provide a new and improved air compressor having a pair of intercoolers and an aftercooler for effectively cooling the compressed air delivered to a storage reservoir in a railway braking system.

Another object of this invention is to provide a unique air-cooled, multi-cylinder, two-stage air compressor for effectively reducing the temperature of the compressed air at the outlet of an aftercooler to as close as possible to atmospheric ambient temperature, so that when the air has passed through the remaining main reservoir system it is at ambient temperature before being used by the brake equipment and auxiliary devices on the locomotive.

A further object of this invention is to provide an air compressor having a pair of low pressure cylinders and a high pressure cylinder in which a pair of intercoolers are connected between the outlets of the pair of the low pressure cylinders and the inlet of the high pressure cylinder and having an aftercooler connected to the outlet of the high pressure cylinder by a suitable high pressure discharge pipe and which are effectively cooled by forced air blown by a compressor-driven fan.

Yet another object of this invention is to provide a novel air-cooled air compressor having intercoolers and an aftercooler for maximizing the cooling effect from air displaced and moved by a rotary cooling fan.

Yet a further object of this invention is to provide an improved forced-air-cooled pneumatic compressor which is reliable in operation, simple in design, economical in construction, efficient in service and durable in use.

Still a further object of this invention is to provide a multi-cylinder, two-stage air compressor comprising, at least one low pressure cylinder and at least one high pressure cylinder, an intercooler connected between said low and high pressure cylinders, an aftercooler connected to the outlet of said high pressure cylinder, a cooling fan connected to and driven by the shaft of the air compressor and a protective housing including a screened opening and a shroud surrounding said screened opening for directing air through the intercooler and the aftercooler for effectively cooling the compressed air so that the temperature of the delivered air approaches that of the atmospheric ambient temperature.

Still another object of this invention is to provide an air compressor comprising, a first and second low pressure cylinder and a high pressure cylinder, a first intercooler interconnected from the outlet of the first low pressure cylinder to the inlet of the high pressure cylinder, a second intercooler interconnected from the outlet of the second low pressure cylinder to the inlet of the high pressure cylinder, an aftercooler interconnected from the outlet of the high pressure cylinder to the inlet of an air storage reservoir, a cooling fan driven by the crankshaft of the air compressor a protective enclosure covering fan and having an intake opening and an inner cylinder shroud encompassing the screened opening for directing cooling air over the first and second intercoolers and the aftercooler for effectively dissipating the heat of the compressed air so that the temperature of air supplied to the air storage reservoir is substantially at atmospheric ambient temperature.

In addition, it is an object of this invention to provide an intercooler-aftercooler assembly which is disposed adjacent the cooling fan mounted on the output crankshaft of the air compressor to provide both a more practical and a higher efficient arrangement for a main reservoir system.

An additional object of this invention is to provide a compressed air supply system to provide low pressure saturated air at ambient temperature to the brake equipment and auxiliary device of a main reservoir system in which the air has a lower relative humidity and dewpoint.

Still an additional object of this invention is to simplify a two-stage air compressor system which eliminates the need of a complex cyclical type of air dryer apparatus.

DESCRIPTION OF THE DRAWINGS

The above objects and other attendant features and advantages will be more readily appreciated as the present invention becomes better understood by reference to the following detailed description when considered in conjunction with the accompanying drawings, wherein.

DETAILED DESCRIPTION OF THE INVENTION

Figure 1:
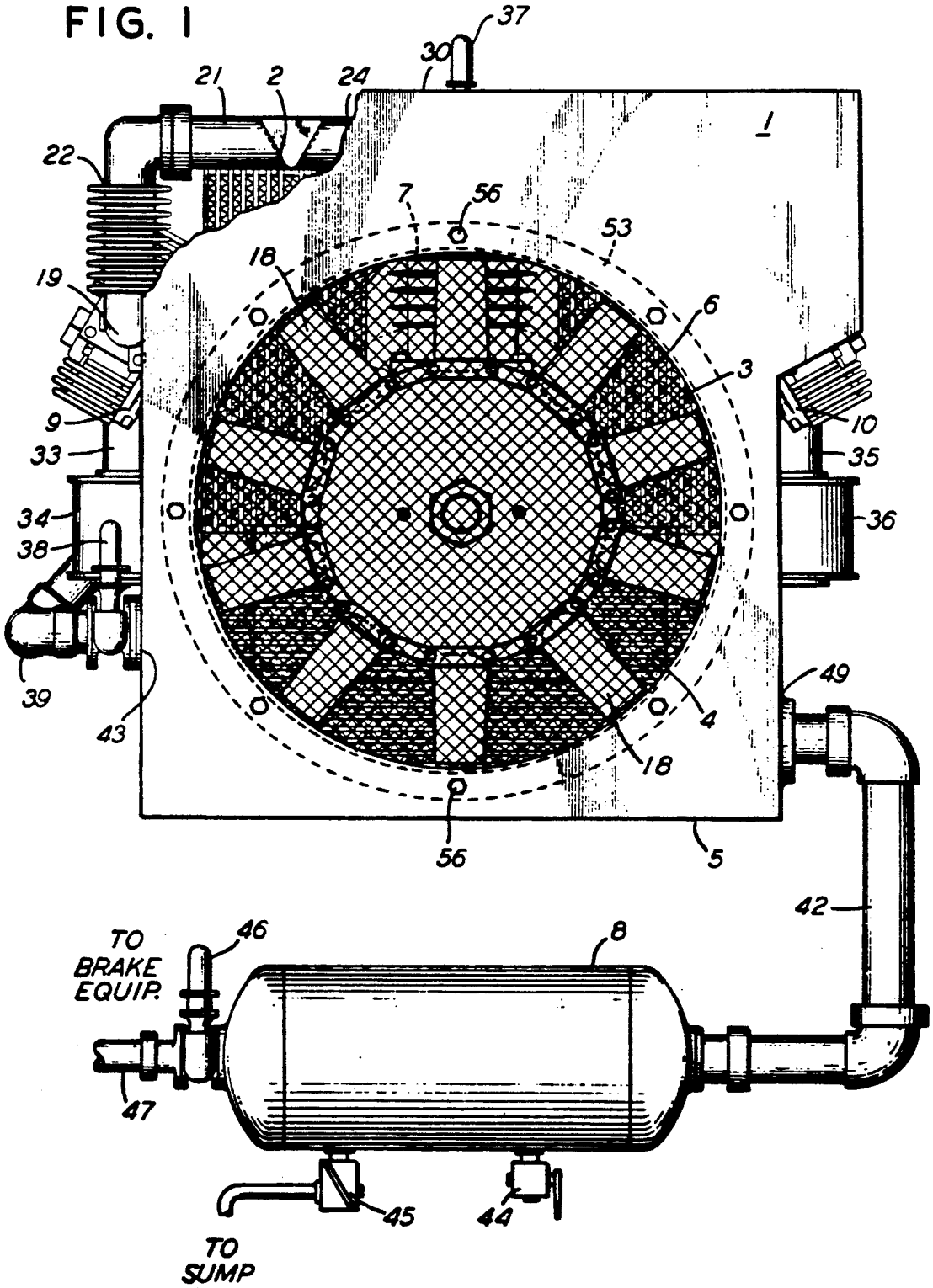
FIG. 1 is an end elevational view of a multi-cylinder, two-stage air compressor arrangement, in which a portion of the protective cover is broken away, embodying the teachings of the present invention.
Figure 2:
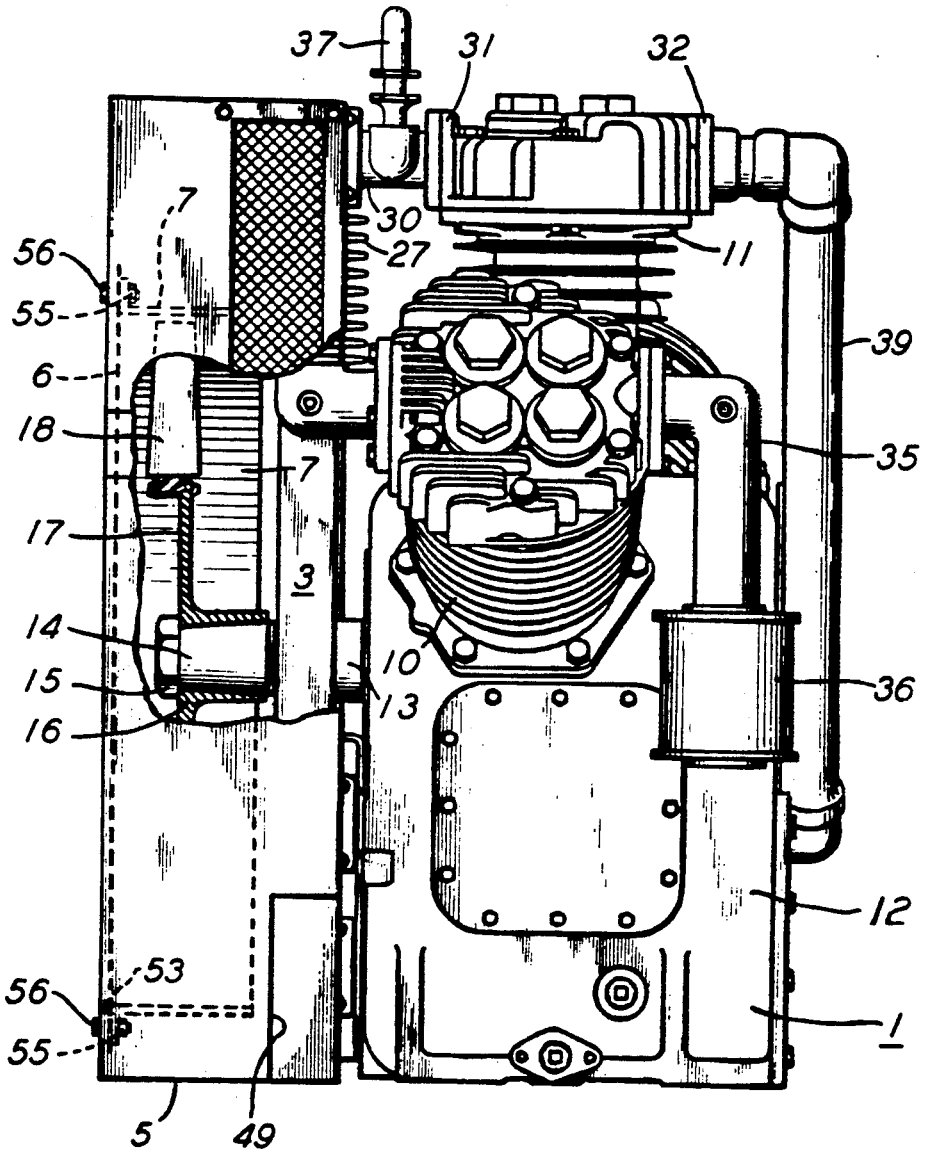
FIG. 2 is a side elevational view, with a portion of the protective cover and shroud broken away, of the air compressor of FIG. 1.

Referring now to the drawings, and in particular to FIGS. 1 and 2, there is shown an air compressing system including an air compressor 1, a pair of intercoolers 2 and 3, an aftercooler 4, a protective housing 5 including a circular intake opening covered by screen 6 and a shroud 7, a main storage reservoir 8, and the associated piping.

It will be seen that the air compressor 1 is a multi-cylinder, two-stage, air-cooled compressor having a first low pressure cylinder 9 and a second low pressure cylinder 10 and a high pressure cylinder 11, each of which is provided with cooling fins. As shown, the pair of low pressure cylinders 9 and 10 and the high pressure cylinder 11 are mounted on and are supported by a crankcase 12 in the usual manner and contain pistons which are actuated by connecting rods driven by a rotary crankshaft 13. The one end (not shown) of crankshaft 13 is coupled to and driven by a suitable rotatable prime mover, such as, an electric motor or the like, while the other end 14 of crankshaft 13 is keyed and threadedly attached by a locknut 15 to the hub and wheel 16 of a rotary cooling fan assembly 17. The fan assembly 17 includes a plurality of equally spaced blade members 18 securely attached to the periphery of the rotating wheel 16. In practice, there are ten (10) fan blades 18 angularly spaced on thirty-six degree (36°) center lines around the perimeter of the wheel 16. The blades 18 are aerodynamically designed to effectively draw and pull free air from the surrounding milieu. There are several advantages of having the compressor directly driving the cooling fan 17. For example, when the demand and speed of the air compressor increase, the speed and the cooling capacity of the fan is proportionally increased. The fan can only stop turning when the compressor stops working or ceases to rotate. It has been found that the use of a separate electric motor for driving the cooling fan is unreliable since failure of the motor would result in the loss of the cooling effect and could allow the temperature of the rotating compressor to rise to dangerously high levels which could cause deterioration of the lubricating oil and could result in seizure of the air compressor.

Figure 3:
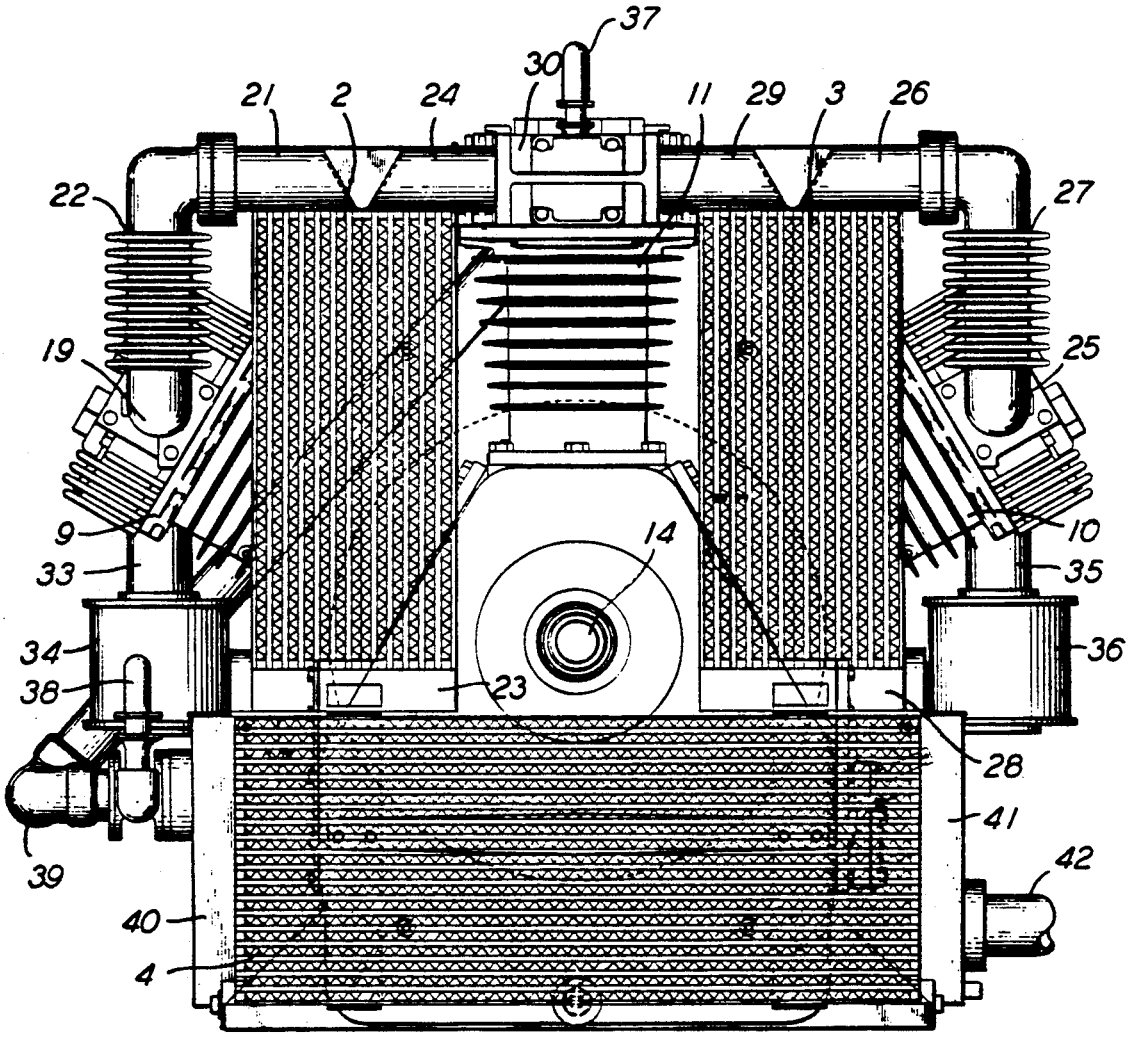
FIG. 3 is an end elevational view of the air compressor of FIG. 1 with the protective cover, screen and shroud removed.
Figure 4:
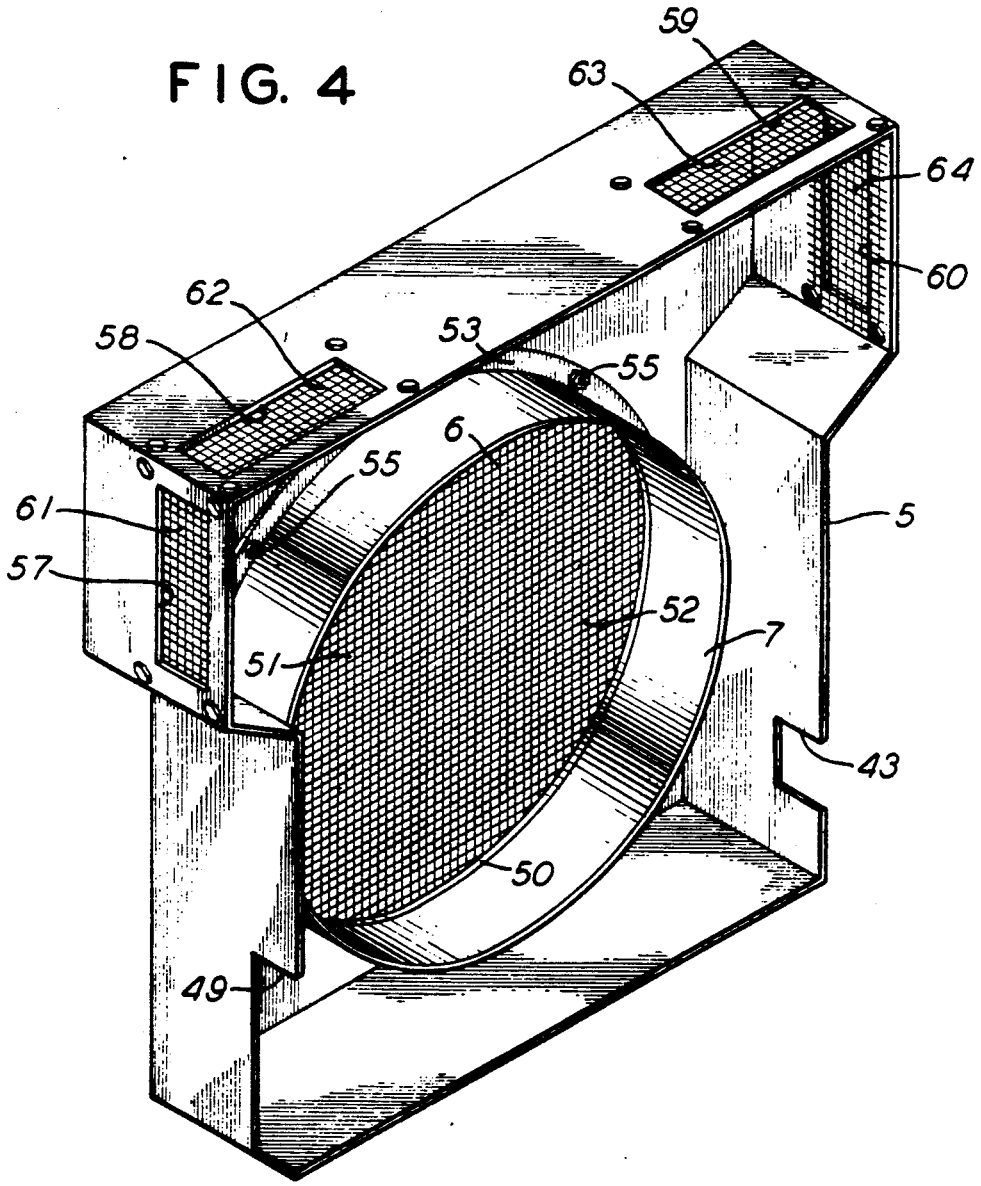
FIG. 4 is a perspective view as viewed from the inward side of the protective housing including a screen and shroud.

As shown in FIGS. 1, 2, and 3, the inlet of the low pressure cylinder 9 is connected by conduit 33 to an intake filter 34, while the inlet of the low pressure cylinder 10 is connected by conduit 35 to an air intake filter 36. It will be seen that outlet 19 of the low pressure cylinder 9 is connected to an inlet header 21 of the first aluminum fin core intercooler 2 via the finned riser pipe 22. The inlet header 21 is interconnected by a first plurality of parallel tube-like passages of the first intercooler 2 to a common header 23. The common header 23 is connected to an outlet header 24 via a second plurality of parallel tube-like passages of the first intercooler 2. The outlet header 24 is connected to one inlet of a T-pipe fitting 30. Similarly, the outlet 25 of the low pressure cylinder 10 is connected to an inlet header 26 of the second aluminum fin core intercooler 3 via a finned riser pipe 27. It will be seen that the inlet header 26 is interconnected to a common header 28 via a first plurality of parallel tube-like passages of the second intercooler 3. As shown, the common header 28 is interconnected to an outlet header 29 via a second plurality of parallel tube-like passages of the second intercooler 3. It will be noted that the outlet header 29 is connected to the other inlet of the T-pipe fitting 30, while the outlet of the T-pipe fitting 30 is connected to the inlet 31 of the high pressure cylinder 11. A safety valve 37 is mounted to the T-pipe fitting 30 as a means to warn personnel of high pressure discharge valve malfunctioning due to failure or obstruction on the valve seat. The outlet 32 of high pressure cylinder 11 is connected by suitable conduits and fittings forming piping 39 to the inlet header 40 of the aluminum fin core aftercooler 4. In practice, the lower left-hand side of housing 5 is provided with a cut-out 43 for accommodating fitting of piping 39, as shown in FIGS. 1 and 4. Preferably, a safety valve 38, such as, the well known E-7-C safety valve is located on the inlet side of the aftercooler and is normally set to approximately 175 psi. The inlet header 40 is interconnected to an outlet header 41 by a plurality of parallel one-way flow, tube-like passages. The tube-like passages of both the intercoolers and aftercoolers are made up of short tubelets which form staggered passageways having a height of approximately 3 to 6 millimeters. The outlet header 41 is connected by suitable conduits and fittings forming piping 42 via side wall cut-out 49 to the inlet of the main storage reservoir 8 which includes a manual drain cock 44 as well as an automatic drain cock 45 to empty and remove the condensated water from the air before it is passed on downstream to the operating and control brake equipment and related devices. The outlet of the storage reservoir 8 is connected to an E-7-C safety or regulator valve 46 which is normally set at approximately 150 psi. Thus, the compressed air conveyed to outlet pipe 47 and, in turn, supplied to the brake equipment and related devices is dry and is as close as possible to atmospheric ambient temperature so that corrosion and deterioration of the braking apparatus are minimized and therefore the mean time between maintenance repair and replacement is maximized.

Referring now to FIG. 4, there is shown the skirted protective housing or enclosure 5 including a safety screen 6 and an air directing shroud 7. The housing 5 is a welded box-like T-shaped structure which may be fabricated of sheet steel which is suitably secured, such as being bolted, to the body of the air compressor 1. The upper portion of the protective housing 5 substantially covers the intercoolers 2 and 3 and the riser pipes 22 and 27, which the lower portion of the enclosure 5 encompasses the aftercooler 4 to protect individuals from physically contacting the hot areas on the compressor. It will be seen that the front of the housing is provided with a circular air intake opening 50. The air intake opening is covered with a perforated metal screen 6 of suitable mesh to prevent any individual from coming in contact with the high-speed rotating fan assembly 17. The screened opening is also made to the maximum diameter of the fan blades 18 for maximum efficiency and air flow. That is, the tips of the fan blades 18 come within a fraction of an inch of the inner periphery of the cylindrical shroud 7 in order to minimize air turbulence and maximize air flow. In practice, the screen 6 includes triangular, rectangular, or square openings to maximize the open area of the holes 51, while minimizing the surface area of the air impeding interconnecting portions or lattices 52. The internal shroud 7 takes the form of a hollow cylinder member having an inner periphery equal to the diameter of the air intake opening having a suitable depth, such as approximately four to six inches (4–6") deep. A flat, ring-like member 53 is welded to the one end of the cylindrical shroud 7 to form a circular flange. A plurality of equally-spaced holes is drilled through the outer periphery of the flange member 53. As shown, the perforated screen 7 is disposed or sandwiched between the flange member 53 and the inside of the housing 5 and is securely fixed in place by nuts 55 and bolts 56 which pass through the drilled holes in the flange member 53 and corresponding aligned holes formed in the screen member 6 and the face of the protective housing 5. It will be seen that the upper corners of the enclosure 5 are provided with a plurality of gridded rectangular outlet openings 57, 58, 59 and 60, which effectively allow the heat in the risers 22 and 27 to be quickly dissipated by both natural and transferred convection, and forced air cooling. As shown, the rectangular openings 57, 58, 59 and 60 are covered by perforated screens 61, 62, 63, and 64, respectively, which are screwed or bolted to the housing 5. In laboratory tests performed at compressor speeds of 450 rpm, 650 rpm, 850 rpm and 1050 rpm, the temperatures at discharge end of the aftercooler 3 were 5° F., 7° F., 9° F., and 13° F., respectively, above the prevailing atmospheric ambient temperature. Thus, it will be seen that the present air compressor system effectively reduces the temperature of the compressed air delivered to the main storage reservoir, and that air supplied from the main storage reservoir to the braking apparatus is relatively dry and near atmospheric ambient temperature.

Thus, the present invention has been described in such full, clear, concise and exact terms as to enable any person skilled in the art to which it pertains to make and use the same, and having set forth the best mode contemplated of carrying out this invention. We state that the subject matter, which we regard as being our invention, is particularly pointed out and distinctly asserted in what is claimed. It will be understood that variations, modifications, equivalents and substitutions for components of the above specifically-described embodiment of the invention may be made by those skilled in the art without departing from the spirit and scope of the invention as set forth in the appended claims.

We claim:

1. A multi-cylinder, two-stage, air compressor comprising, at least one low pressure cylinder and at least one high pressure cylinder, an intercooler connected between said low and high pressure cylinders, an aftercooler connected to the outlet of said high pressure cylinder, a cooling fan having blades and a hub connected to and driven by the shaft of the air compressor, a protective housing, a screened opening and a shroud, said screened opening and shroud directing air through said intercooler and said aftercooler for effectively cooling the compressed air so that the temperature of the delivered air approaches that of the atmospheric ambient temperature, the diameter of said fan blades is substantially equal to that of said screened opening and the tips of said fan blades coming within a fraction of an inch of the inner periphery of said shroud in order to minimize air turbulance and maximize air flow.

2. The multi-cylinder, two-stage air compressor as defined in claim 1, wherein said shroud is a cylindrical member secured to the inside of said protective cover.

3. The multi-cylinder, two-stage air compressor as defined in claim 1, wherein said protective housing is a metallic box-like structure placed over the exposed end of the air compressor.

4. The multi-cylinder, two-stage air compressor as defined in claim 1, wherein the air compressor includes a pair of low pressure cylinders and a single high pressure cylinder.

5. The multi-cylinder, two-stage air compressor as defined in claim 1, wherein said aftercooler includes an inlet header and an outlet header interconnected by a plurality of finned core tubes.

6. The multi-cylinder, two-stage air compressor as defined in claim 1, wherein said protective housing is a fabricated sheet metal structure.

7. The multi-cylinder, two-stage air compressor as defined in claim 1, wherein the cooled compressed air is supplied to a storage reservoir.

8. The multi-cylinder, two-stage air compressor as defined in claim 1, wherein said intercooler includes an inlet header interconnected to a common header by a first plurality of finned core tubes and includes an outlet header interconnected to said common header by a second plurality of finned core tubes.

9. The multi-cylinder, two-stage air compressor as defined in claim 1, wherein said shroud is a flanged, cylindrical member which is bolted to the inside of said protective cover.

10. The multi-cylinder, two-stage air compressor as defined in claim 1, wherein said intercooler and said aftercooler are fabricated of fin core of aluminum structure.

11. An air compressor comprising, a first and second low pressure cylinder and a high pressure cylinder, a first intercooler interconnected from the outlet of said first low pressure cylinder to the inlet of said high pressure cylinder, a second intercooler interconnected from the outlet of said second low pressure cylinder to the inlet of said high pressure cylinder, a bladed cooling fan driven by the crankshaft of the air compressor, an aftercooler interconnected from the outlet of said high pressure cylinder to the inlet of an air storage reservoir, a protective enclosure covering said fan and having an intake opening, a screen and a cylindrical shroud encompassing said screened opening for directing cooling air over said first and second intercoolers and said aftercooler for effectively dissipating the heat of the compressed air so that the temperature of air supplied to said air storage reservoir is near atmospheric ambient temperature, said screened opening having a diameter substantially equal to the diameter of said fan and the tips of the fan blades extending within a fraction of an inch of the inner periphery of said cylindrical shroud to minimize air turbulance and maximize air flow.

12. The air compressor as defined in claim 11, wherein said protective enclosure is a skirted sheet metal box-like structure.

13. The air compressor as defined in claim 11, wherein said first and second inner cooler each include an inlet header interconnected to a common header by a first fin core structure and include an outlet header interconnected to said common header by a second fin core structure.

14. The air compressor as defined in claim 13, wherein said aftercooler includes an inlet header interconnected to an outlet header by a fin core structure.

15. The air compressor as defined in claim 11, wherein said fan draws the air through said intake opening, said screen, and said inner cylindrical shroud for directing the air over said intercoolers and said aftercooler.

16. The air compressor as defined in claim 11, wherein said fan includes a hub bolted to said crankshaft and a circular plate having a plurality of blades attached to the periphery thereof.

17. The air compressor as defined in claim 11, wherein said first and second intercoolers are disposed in side-by-side relationship with each other and said aftercooler is disposed below said first and second intercoolers.

18. The air compressor as defined in claim 11, wherein said cylindrical shroud includes a flat circular flange welded to one end thereof.

19. The air compressor as defined in claim 18, said screen is sandwiched between said flat circular flange and the inside surface of said protective enclosure for covering said intake opening.

20. The air compressor as defined in claim 11, wherein said protective enclosure includes a plurality of gridded outlets to allow for the dissipation of heat.

* * * * *

UNITED STATES PATENT AND TRADEMARK OFFICE

CERTIFICATE OF CORRECTION

PATENT NO. : 5,106,270

DATED : April 21, 1992

INVENTOR(S) : Walter E. Goettel et al

It is certified that error appears in the above-identified patent and that said Letters Patent is hereby corrected as shown below:

Column 6, line 68, delete "the inside of"

Signed and Sealed this

Sixth Day of July, 1993

*Attest:*

Michael K. Kirk

MICHAEL K. KIRK

*Attesting Officer*

*Acting Commissioner of Patents and Trademarks*